United States Patent [19]

Colla

[11] 4,183,136

[45] Jan. 15, 1980

[54] TEMPERATURE SENSING RESISTANCE DEVICE

[75] Inventor: Jeannine O. Colla, Whitefish Bay, Wis.

[73] Assignee: Johnson Controls, Inc., Milwaukee, Wis.

[21] Appl. No.: 821,516

[22] Filed: Aug. 3, 1977

[51] Int. Cl.[2] ..... H01C 7/00; H01C 17/28

[52] U.S. Cl. ..... 29/620; 29/621; 29/627; 338/25; 338/308

[58] Field of Search ..... 29/620, 611, 627, 628, 29/630 R, 621; 338/275, 25, 308

[56] References Cited

U.S. PATENT DOCUMENTS

| | | | |
|---|---|---|---|
| 3,517,436 | 6/1970 | Zandman | 29/620 |
| 3,778,744 | 12/1973 | Brandi | 338/275 |
| 3,842,495 | 10/1974 | Bennett | 29/620 |

FOREIGN PATENT DOCUMENTS

| | | | |
|---|---|---|---|
| 1440897 | 6/1976 | United Kingdom | 29/620 |

*Primary Examiner*—Francis S. Husar

*Assistant Examiner*—Gene P. Crosby

*Attorney, Agent, or Firm*—Andrus, Sceales, Starke & Sawall

[57] ABSTRACT

A temperature sensitive thick film resistor unit for use in detecting and control systems is formed employing thick film plating technology. A final sized negative is formed from enlarged artwork and transferred to a photosensitive emulsion supported on a stainless steel screen to form a printing stencil. A fritted molecular bonding nickel paste including finely divided vitreous and nickel particles in a solvent carrier is screen printed onto an alumina substrate by a pressure printer in which the paste is forced through the screen to control the thickness of the deposited nickel paste. The deposited nickel is allowed to settle and partially heated to remove gases and organic solvents. A highly conductive film is overlaid on tab connecting ends and the unit is fired to intimately attach the nickel paste to the substrate by the formation of a chemical bond. Nickel in appropriate form for printing is a readily available material and also provides a significant and linear change in resistance per unit of temperature change.

21 Claims, 8 Drawing Figures

RESISTANCE IN OHMS
1200
1100
1080
1060
1040
1020
1000
TEMPERATURE IN °C.
20
25
30
35
40
10/14/75
10/14/75
10/29/75
8/19/76
10/29/75

RESISTANCE IN OHMS
1200
1160
1120
1080
1040
1000
960
920
TEMPERATURE IN °F.
20
30
40
50
60
70
80
90
100
110
120

TEMPERATURE SENSING RESISTANCE DEVICE

BACKGROUND OF THE INVENTION

This invention relates to a temperature sensing resistance device and particularly to a unique thick film resistor device for continuous monitoring of temperature.

In various monitoring and control circuits, continuous monitoring of a temperature condition may be required. For example, environmental controls for heating and cooling of buildings requires sensing existing conditions and developing control signals based thereon. Although various sensing devices have been proposed, the design of a device for precise continuous temperature monitoring at a relatively low cost has presented a continuous problem. Generally, the present designs are based upon one of three different temperature sensing elements including a: (1) thermocouple; (2) a thermistor and; (3) a resistance thermometer. A thermocouple which measures the temperature differential at the junction of two dissimilar metals provides an indirect signal, unless the one side of the junction is maintained and/or compensated to a reference temperature. Thermistors and resistance thermometers provide a direct indication of absolute temperature. Thermistors are generally semi-conductor devices having a high negative temperature coefficient of resistance. While thermistors avoid the objection of thermocouples, the device is relatively non-linear over many ranges of temperatures encountered in environmental and other controls and the response changes with time. Resistance thermometer devices are generally formed with a platinum element which functions with a high degree of accuracy and linearity. A thick film platinum element has recently and after the present invention has been made available by Engelhard Minerals and Chemical Corporation of New Jersey, (hereinafter referred to as Engelhard). Another device employing a bonded conductive track is available from Mathey Bishop, Inc. as thermafilm 100 R 30 sensors. The use of platinum, of course, results in a relatively high cost sensor and one which is also significantly vulnerable to mechanical damage.

There is a need, therefore, for a stable, long life and relatively low cost resistance sensor which produces a linear response over a relatively wide temperature sensing range such as encountered in many environmental and other control systems.

SUMMARY OF THE PRESENT INVENTION

The present invention is directed to a temperature sensing thick film resistor unit and to the method of forming such thick film resistor unit. Generally, in accordance with the present invention, a conductive grid pattern of a conductive metal is deposited on a stable insulating substrate as a thick film resistor and fired at an appropriate elevated temperature to effect a integral and in particular a molecular bond of the conductive metal to the substrate. The inventor has disclosed that a particular unique and satisfactory thick film conductor is nickel which can be intimately and molecularly bonded to a substrate of alumina, beryllia, or the like. Nickel provides a material which is readily available, is adaptable to thick film technology and provides a significant change in resistance per unit of temperature change. The output is substantially linear over a wide change in temperature. Appropriate lead conductor films may be overlaid on the metal and fired to permit attachment of connecting leads by soldering. The unit is completed by an outer protective coating to establish optimum humidity resistance and also protect the conductor against abrasion. The temperature sensing thick film resistor unit provides a practical and relatively inexpensive unit having essentially linear characteristics over a wide range of temperatures. The unit is highly shock and vibration resistant and may thus be employed in industrial and institutional environments. The stability and the relative large output signal of the unit permits use in conventional temperature sensing instrumentation without the necessity of complex compensating circuits and the like.

In accordance with a preferred and highly unique sensing unit, the unit is formed by screen printing of a grid of an air firable nickel conductor fritted paste onto a substrate member formed of alumina or beryllia. A thin layer of oxide and some glass phase characteristics appear on the fired nickel to which it is difficult to solder electrical contacts. An overprint of readily soldered conductors such as Gold-Palladium material, a Silver-Palladium or other suitable material is applied to appropriate portions of the nickel grid after which the unit is fired to integrally and chemically bond the nickel grid to the substrate. Gold-Palladium is preferred. Connecting wires or leads are then soldered to the connectors portion. The nickel resistor is then trimmed to establish the desired resistance at a reference temperature, preferably by known abrasive or chemical etching methods. The unit is then encapsulated or coated to protect the device against mechanical abrasion and seal the resistor against humidity.

The unit is preferably formed employing a hybrid thick film processing technique in which a final sized negative is formed from enlarged artwork. The image is transferred to a photosensitive emulsion supported on a screen to form a printing stencil with the desired pattern. In accordance with an aspect of the present invention, the printer employed for depositing the nickel ink or paste onto the insulating support or substrate includes a pressure system in which the paste is forced through the screen which controls the thickness of the deposited metal. The paste film is allowed to set and then heated at an appropriate temperature to outgas the film and remove organic solvents. After drying, the connector overprint of Gold-Palladium or the like is applied using a connector screen stencil. The connector over print is in turn heated at appropriate temperatures to out-gas the film and remove organic solvents.

The printed unit is then fired, preferably with a particular temperature-time sequence, to eliminate creation of stresses within the unit which might cause thermal cracking of the substrate, and then completed by the addition of the connector leads and the encapsulation.

The present invention has been found to provide a linear temperature sensor which can be constructed employing present production means and produces a sensor having a reliable and long life at relatively low cost.

DESCRIPTION OF THE DRAWINGS

The drawings furnished herewith illustrate a preferred construction of the present invention in which the above advantages and features are clearly disclosed as well as others which will be readily understood from the following description.

In the drawings.

DESCRIPTION OF THE ILLUSTRATED EMBODIMENT

Figure 1:
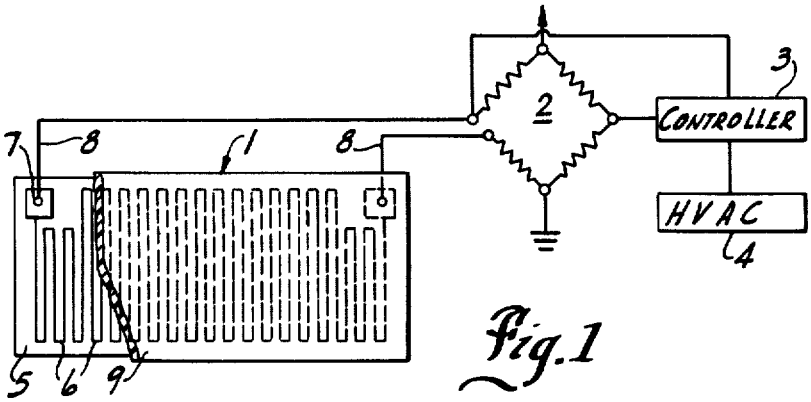
FIG. 1 is a diagrammatic view of a temperature sensing film resistor unit constructed in accordance with the teaching of the present invention and connected to a control circuit.
Figure 3:
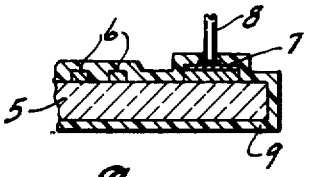
FIG. 3 is an enlarged vertical fragmentary cross-section taken generally on line 3—3 of FIG. 2.
Figure 2:
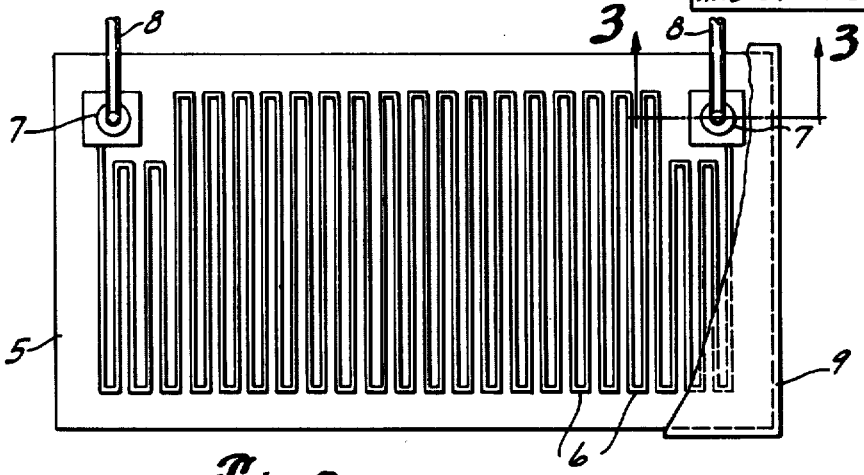
FIG. 2 is a plan view of the resistor element shown in FIG. 1 and more clearly illustrates one grid pattern.

Referring to the drawings and particularly to FIG. 1, a temperature sensing unit 1 is illustrated connected in a control circuit, such as an environmental temperature control system. The temperature sensing unit 1 as more fully developed hereinafter provides a resistance which varies with temperature. The unit 1 is shown connected in a bridge network 2 and thus controls the input signal to a controller 3. The output of controller 3 controls a cooling and/or heating device 4 to maintain the surrounding environment at a selected temperature. In accordance with the present invention, the temperature sensing unit 1 is specially constructed with an insulating base or substrate 5 to which a conductive metal grid 6 is intimately secured as a thick film deposited resistor. The resistor 6 terminates in connecting tab 7 to which electrical wires 8 are secured to define terminals for connecting of the sensing device into circuit. An outer protective coating 9 of suitable plastic such as polyurethane encloses the resistor 6 to prevent abrading and to make the device essentially insensitive to humidity conditions. The base 5 is a suitable high temperature electrical insulating material such as alumina, beryllia or the like, which can be fired at high temperatures. However, ordinary glass such as employed in standard laboratory glass slides has also been used. Alumina or beryllia is also impervious to water and forms a highly stable support, both electrically and mechanically, over a wide range of temperatures. Both materials are also good heat dissipators, alumina being approximately 20 times better than glass and beryllia about 135 times better than glass. Such material is also commercially available with a high degree of uniformity and consistancy. This is desireable as it minimizes the number of variables introduced into the commercial production process. Alumina has been particularly employed and is referred to hereinafter. The metal grid conductor or resistor 6 is suitable finely divided metal conductor which has a significant temperature coefficient of resistance and is in vitreous carrier which forms an intimate chemical bond to substrate 5 when applied employing thick film technology. Nickel is particularly a desirable material because it has a large coefficient of resistance and develops a relatively large resistance change per unit temperature change. This produces relatively significant change in the signal output with minor temperature changes. Further, finely divided nickel in a suitable glass frit which can be fired to form a strong chemical bond with the alumina and the like is readily available. It produces a highly stable and reliable unit.

Nickel is also highly desirable because it is compatible with many precious metal conductors which can be employed in forming the interconnecting tabs 7. Thus, the formation of the firm chemical bond between the fritted nickel grid and the base requires high temperature firing. However, under such conditions, thin layers of oxides and some glass phases develop on the outer conducting nickel surface. It is difficult to solder electrical contacts to such a nickel surface and the tab is thus formed by intimately bonding a suitable precious metal to the ends of the grid.

The present invention preferably forms unit 1 employing a process based on thick film circuit technology which has been employed to form conventional printed circuit board units. Although there is not a precise line between thin and thick film processes, generally in thick film technology the conductor layer is at least 10 mils. thick. In one embodiment to be described, a 0.025 inch thick plate 5 has a nickel grid in excess of 10 mils. applied to the plate.

The conductor 6 was formed in the well-known grid pattern with parallel conducting legs joined at each end. Although one grid design has been illustrated, any other pattern can, of course, be employed. Thus, the space geometry provided in a particular application may well require some other form of grid pattern adapted to hybrid screen printer.

Figure 4:
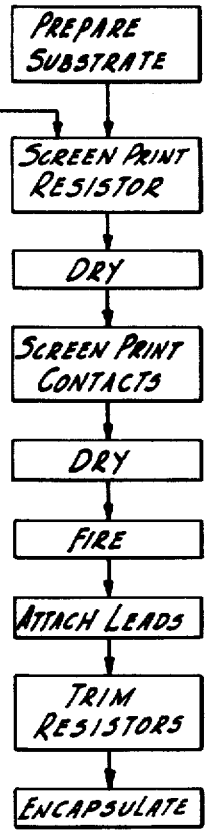
FIG. 4 is a flow diagram for a preferred method of forming the elements of FIGS. 1 and 2.
Figure 5:
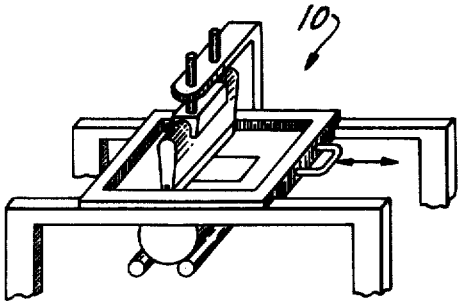
FIG. 5 is a diagrammatic view of the printing of the thick film resistor on the base.

Referring particularly to FIG. 4, the steps in the fabrication of a thick film resistor unit 1 is illustrated.

The grid pattern is initially formed as substantially enlarged artwork, for example, either by drawing directly on a suitable photographic base or by applying opaque black strip tapes to an antistatic mylar drafting film manufactured and sold by Durester. Tape in widths of 0.093 inches is readily available from W. H. Brady Company, Milwaukee, Wis. A reduced negative of the grid pattern is made to the final grid pattern size through the use of any suitable well known camera reduction. A positive image is then made from the negative. An emulsion screen stencil is developed from the positive. A 200 mesh stainless steel screen and a violet film which is commercially available from the Advance Process Supply Company have been used. A standard readily available system is a chromaline screen emulsion system of the type B-100-1-mil. Generally, in this system, the dry emulsion film is supported on a release paper. The dry emulsion film is applied to the contact side of the stainless steel screen to assure a very accurate thickness of the emulsion. A compatible fluid emulsion is applied over the screen mesh to completely fill the metal fabric while locking of the emulsion film to the screen. The contact fluid emulsion also provides an automatic total sensitizing of the screen which is then dried and the release paper removed. The positive image film pattern is properly aligned on the photosensitive emulsion-screen, positioned in a vacuum frame and exposed to an actinic light source, with the unexposed areas washed out by gentle spraying to both sides of the screen after a one or two minute soak in warm water. This forms a finished stencil which is in condition for screen printing in a pressure printer which forms a particularly significant aspect of the present invention.

Prior to the actual screening, the substrate 5 is appropriately treated to insure a highly effective bond on the resistor 6 to the substrate surface. The presence of contamination can adversely effect the adhesion and the electrical performance of the thick film resistor. The substrate 5 is preferably ultrasonically cleaned with an alcohol solvent and immediately thereafter the resistor 6 is screen printed.

The screen printing process as hereinafter discussed is also carried out in an ultra-clean work station such as a horizontal flow ultra-clean work station of a conventional construction.

Although described in the preferred embodiment, employing a screen, other masking means could of course be employed to define the grid for depositing of unique nickel grid element or conductor 6.

The substrate 5 is preferably a ceramic material which can stand the high temperatures required during the firing steps to provide the intimate chemical bond between the substrate 5 and the resistor conductors. A highly satisfactory material is 96% weight percent alumina ceramic which is available as 0.025 inch thick, 2×1 inch plate, manufactured and sold by Technical Ceramics Division of Minnesota Mining and Manufacturing Company or 3M Company. The material has a 25 microinch AA surface which provides an ideal foundation for thick film circuitry.

The substrate is mounted in the screen printing unit 10, with the stencil supporting abutting the substrate. Unit 10 is shown as a simple manually operated device. An electronic Model All-Metal Cam-Lok Printing Frame may be employed to support the screen. The printing essentially consists of forcing a viscous molecular bonding ink through the preprocessed openings in the stencil screen to deposit the grid pattern 6 on the substrate 5. A particularly satisfactory material is an air firable nickel conductor material such as a paste-like material manufactured and sold by Engelhard and more fully identified as a molecular bonding nickel ink number A-2884. This material is a printing formulation and includes finely divided vitreous material and finely divided nickel mixed with suitable organic binders and solvents, with the particles of a controlled size, shape and composition. Generally, the nickel particles are ground to a fineness of below 20 microns and the nickel particles are thoroughly dispersed in a suitable carrier. The ink or paste should be stirred prior to use to remove any sediment or lumps which remain as shipped or which may occur as a result of settling after time of delivery. The fritted ink is preferably stored on rotating rollers to prevent the solids from settling out significantly between screen printing operations.

A significant aspect of the unique hybrid process is the pressure screen printing of the conductor 6 in order to maintain a high degree of reproductability in a practical and economical manner. The screen printing process employs a pressurized forcing of the viscous nickel ink through the openings in the stencil screen and thereby depositing the metal on the substrate 5. Generally, the stencil is accurately positioned within a support and a transfer mechanism moved across the screen to force the ink into and through the stencil screen. A hand operated screen printer has been employed with a sliding or brush action squeegee. The printer would preferably be automated with means to control the pressure of the squeegee and the speed to maintain a high degree of reproducibility.

After the pressure screen printing of the ink onto the substrate, the assembly is allowed to dry at a somewhat elevated temperature to outgas the deposited film and remove organic solvent.

After drying and outgassing, the resistor grid screen is replaced with a screen stencil for formation of the soldering tabs 7. The material is again an ink material and in this case employing a highly conductive ink which is adapted to be intimately bonded to the nickel resistor. A particularly satisfactory material providing good solderability to the incoming leads is a frittless silver ink A-2790 manufactured and sold by Engelhard. The overprint application of a contact produces an interface which has no distinct differences, no bubbling and no separation and thus provides a highly effective electrical contact. A lead 8 can be conventionally and directly soldered to the tab 7. Any other readily available material such as gold or platinum alloys which can be applied by screen printing techniques may, of course, be employed. Silver-platinum, silver-palladium and gold-palladium have also been used with the gold-palladium being a preferred film material. The highly conductive ink is screened directly on top of the small end portions of the dry nickel conductor of the grid. The printed unit is again allowed to set for appropriate leveling and then dried at an appropriate temperature.

The overprinted conductor substrate subassembly is then fired at the necessary temperature to create a firm, intimate chemical bond between the nickel resistor 6 and the substrate 5.

The inventor has found that the firing preferably includes an initial relatively low temperature phase during which the organic binder and residual solvents are further removed from the nickel conductor, and then immediately fired at a substantially higher temperature to develop the required characteristics of resistivity and temperature coefficient. The high firing temperature simultaneously sinters the glass material to anchor the molecular nickel to substrate. The sintered subassembly is allowed to cool within the heating unit, with the heat source removed until the temperature decreases to a relatively low temperature during which all of the reaction will occur. Thereafter, the substrate can be rapidly cooled, subject only to a limitation consistant with proper stress relieving of the ceramic material in such a manner as to avoid thermal fracturing. In accordance with the present invention, the interconnecting leads 8 are then soldered to the connecting tabs 7, and then the soldering paste carefully removed from the surfaces of the unit. The resistor 6 is then trimmed to establish the desired resistance at a given reference temperature.

Either of two methods have been employed.

In one method, abrasive trimming of the nickel grid conductor is employed. A protective tape such as Scotch brand tape No. 470 3VEA, a product of the 3M Company of Minneapolis, Minnesota, is applied over the portions of the nickel grid.

The contact wires 8 are connected to a suitable precision meter and the uncovered portion of the nickel grid altered until the desired resistance is obtained. An abrasive air jet has been employed to reduce the width of the element to obtain the desired resistance. The sensor is of course held at the desired reference temperature. The air abrasive processes may tend to heat the sensor. Consequently, care must be taken to adjust the resistance value for any temperature change occurring during the trimming step. Once trimmed the protective tape is carefully removed and the surfaces of the trimmed unit are cleaned in an alcohol solvent for final processing.

Figure 6:
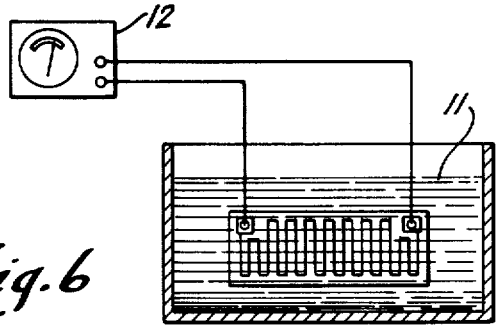
FIG. 6 is a diagrammatic view showing one method of trimming the thick film resistor unit.

Alternately, a chemical etching trimming system can be applied to remove a portion of the nickel resistor for trimming. A resistor equivalent for the given temperature is again calculated. An aqua-regia chemical solution 11 (FIG. 6) is prepared consisting of 3 parts of nitric acid and one part of hydrochloric acid. The wired unit is connected to the precision meter 12 and immersed within the solution to completely cover the conductive nickel grid and uniformily etch the entire grid face. After chemical etching, the trimmed unit is thoroughly rinsed in a suitable deionized water and a final rinse of alcohol solvent to complete the cleaning of the unit for applying of the coating 9, where employed.

In a particularly satisfactory encapsulating step liquid polymer such as polyurethane, such as Conathane, CE-1164, a product of Conap, Inc. is employed. The polymer is an air drying and room temperature curing polyurethane which can be formed into a suitable liquid by Conap S-8 solvent. The trimmed units are dipped in the solution, withdrawn and allowed to dry for a period at room temperature and then cured in elevated temperature. The drying and curing of the deposited coating evaporates the solvents and promotes the subsequent curing reaction of the polymer with the moisture in the air. Although this material is highly satisfactory, it is generally adversely effected by low humidity conditions and, therefore, is not generally suitable for use where the humidity is less than 30%.

The resistance of the sensing unit is, of course, a direct function of film thickness, and somewhat an inverse function of the firing time and temperature. Generally, with a film thickness of, in excess of 6 mils, the resistance is not noticably or significantly different even though the temperature ranges between 800° C. and 870° C. Once completely fired, the elements can be refired without any notable change in the temperature coefficient of resistance.

It is known that the temperature coefficients of relatively pure metals are greatly affected by the introduction or presence of impurities. Thus, it is important to use a relatively pure metal and to prevent contamination during processing.

The molecular bonding of the frit nickel formulation, employed in the preferred construction was found to have a temperature coefficient of resistance very close to that of pure bulk nickel, namely 5900 to 6300 PPM per degree centigrade. The repeatable nature of the process is clearly illustrated in a graphical illustration of FIG. 7. Three different thick film resistors constructed in accordance with the present invention produced essentially the identical curves. Further, to clearly illustrate consistancy of response and characteristic, the data for each curve was normalized so that its resistance values are equivalent at 70° F. The results are presented in the following table:

TABLE 1

| | | Resistance - Temperature Variations | | | | | | | | |
|---|---|---|---|---|---|---|---|---|---|---|
| | | Resistance in Ohms | | | | | | | | Equiv. |
| Temp. (°C.) | Temp. (°F.) | Element A | Element A (Normalized | Element B | Element B (Normalized) | Element C | Element C (Normalized) | Average | Vari-ation | Temp. Vari. (°F.) |
| 0.7 | 33.26 | 951.0Ω | 889.7Ω | 900.1Ω | 890.2Ω | 894.5Ω | 890.7Ω | 890.2Ω | 0.5Ω | 0.17 |
| 5.0 | 41.00 | 974.5 | 911.7 | 922.0 | 911.9 | 916.0 | 912.1 | 911.9 | 0.2 | 0.06 |
| 10.7 | 51.26 | 1006.9 | 942.0 | 952.6 | 942.2 | 946.2 | 942.2 | 942.1 | 0.1 | 0.03 |
| 15.1 | 59.18 | 1032.6 | 966.0 | 976.8 | 966.1 | 970.3 | 966.2 | 966.1 | 0.1 | 0.03 |
| 18.9 | 66.02 | 1055.0 | 987.0 | 998.6 | 987.7 | 991.4 | 987.2 | 987.3 | 0.4 | 0.13 |
| 22.9 | 73.22 | 1079.2 | 1009.6 | 1020.8 | 1009.6 | 1013.9 | 1009.6 | — | — | — |
| 25.0 | 77.00 | 1091.9 | 1021.5 | 1033.0 | 1021.7 | 1025.8 | 1021.5 | 1021.6 | 0.1 | 0.03 |
| 27.5 | 81.5 | 1107.5 | 1036.1 | 1047.5 | 1036.0 | 1040.3 | 1035.9 | 1036.0 | 0.1 | 0.03 |
| 35.8 | 96.44 | 1157.1 | 1082.5 | 1094.1 | 1082.1 | 1086.6 | 1082.0 | 1082.2 | 0.3 | 0.10 |
| 40.5 | 104.9 | 1185.0 | 1108.6 | 1119.9 | 1107.6 | 1113.5 | 1108.8 | 1108.3 | 0.7 | 0.23 |
| 47.1 | 116.78 | 1224.9 | 1145.9 | 1157.3 | 1144.6 | 1150.7 | 1145.8 | 1145.4 | 0.5 | 0.16 |

As seen in the table, the very largest resistance variation is only on the order of 0.7 ohm which is equal to 0.23° F.

Figure 8:
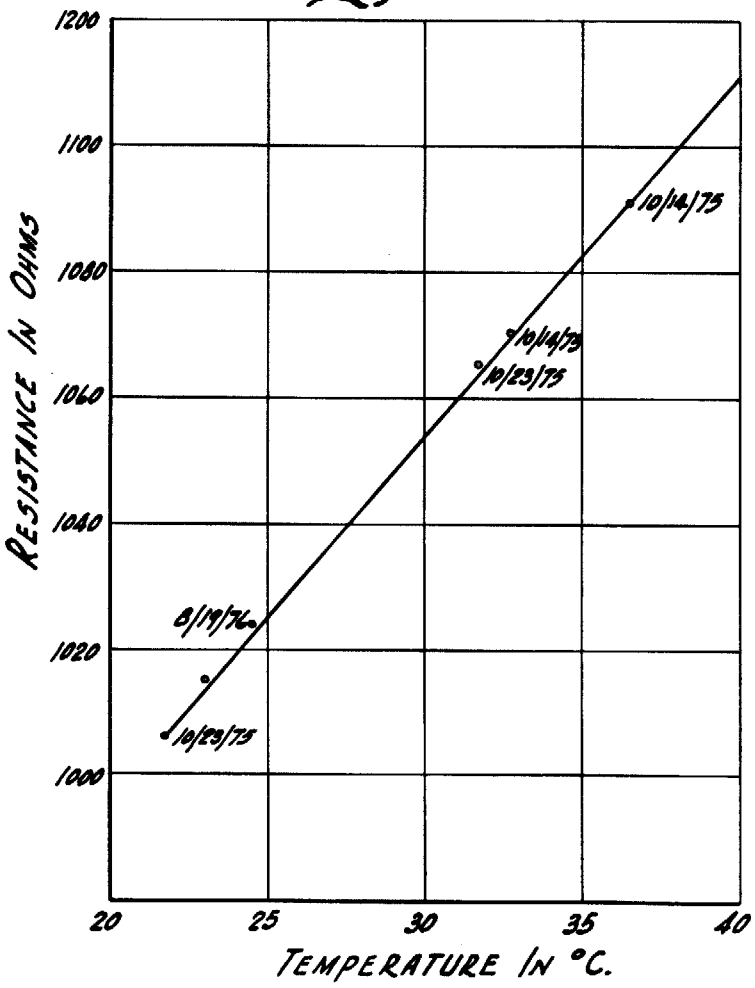
FIG. 8 is a graphical illustration indicating the long term stability of the thick film resistor unit.

As previously noted, the stability with time is particularly significant when the device is employed for significant monitoring in long life systems, such as building automation systems, The graphical illustration of FIG. 8 indicates excellent stability of the unit over a period of approximately one year. In the test, a thick film resistor unit constructed in accordance with the present invention was placed in a test bath of fluid, the unit continued to record to a high degree of accuracy the actual temperature of the bath.

Figure 7:
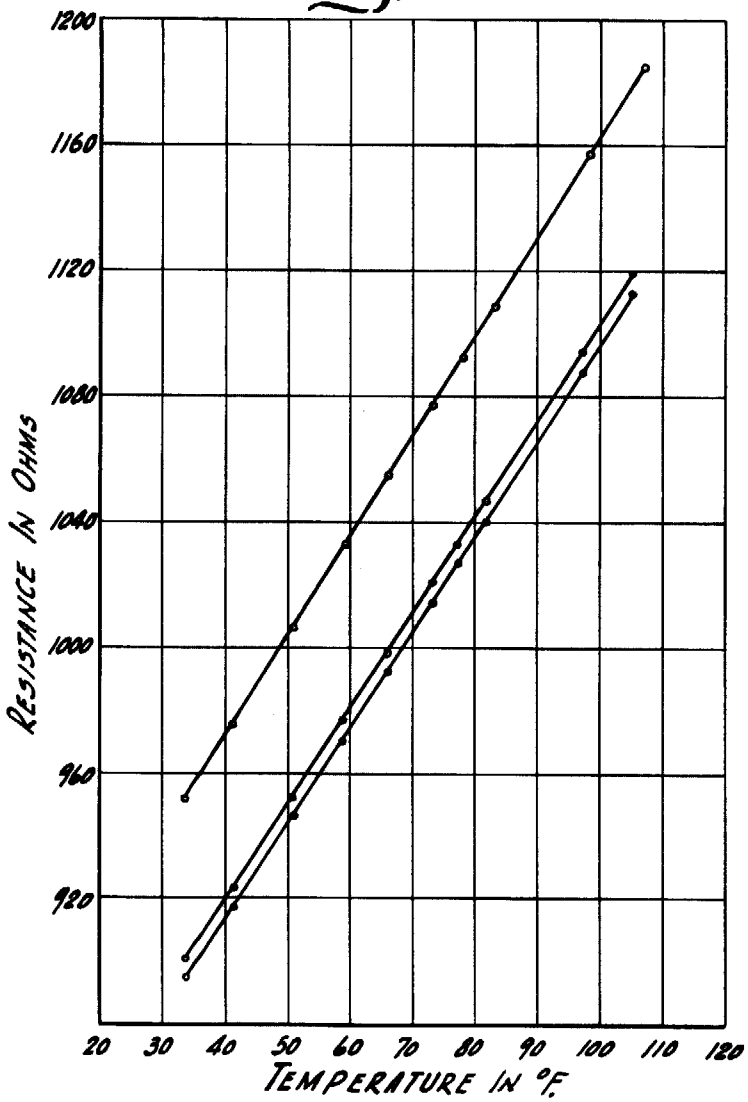
FIG. 7 is a graphical illustration of the characteristics of a series of temperature sensing unit thick film resistor units.

The several samples of FIGS. 7 and 8 were formed as previously described and summarized in the following examples of different temperature sensitive resistance elements made in accordance with the teaching of the present invention. In each instance, the process was carried out using a 200 mesh stainless steel screen although any other suitable screen may of course be employed. Both air-abrasive and chemical methods of trimming were employed.

EXAMPLE 1

| | |
|---|---|
| Substrate Material | Alumina 1 × 2 × 0.025 inches |
| Resistor Material | Engelhard Molecular Bond/Nickel Ink #A2884 |
| Resistor Material Thickness | 0.0006 inches |
| Setting Time | 10 minutes |
| Drying Time - on Panel Heater | 15 minutes |
| Drying Temperature - Panel | 100° C. |
| Connection film material | Engelhard Frittless Silver Ink A2790 |
| Setting Time | 10 minutes |
| Drying Time | 15 minutes |
| Temperature | 100° C. |
| Firing Profile: | |
| Lindberg Furnace | |
| 1. Heat | 550° C. |
| 2. Time | 5 minutes |
| 3. Heat | 850° C. |
| 4. Time | 10 minutes |
| 5. Cool less than 400° F. in closed | |

-continued

| Furnace |
| --- |

Other examples employing the same basic sequences with modification of selected portions produced satisfactory thick film resistors.

In another example, a protective coating was screened over unmasked areas and dried for fifteen minutes at 110° C. before firing for fifteen minutes at 600° C. The coating was an overglaze ink E0031 from Engelhard, to form a low temperature glass glaze coating.

In a third example, a completely glass free or frittless bonding nickel was employed. The specific material employed was Engelhard Molecular Bonding Nickel No. A-2964.

The above bonding nickels of Examples 1 and 2 were bonded to an ordinary glass substrate of a thickness between 0.96 and 1.06 mm employing a firing profile of 600° C. during the final heating. The glass plate was formed from the readily available glass slides employed in the laboratory for supporting a specimen to be reviewed under a microscope. The glass has a lower melting temperature and the firing profile of 600° C. rather than 850° C. was thus necessary.

In other examples, A-3146 silver-platinum and A-2572 silver-palladium were employed to form the connection films prior to the molecular bonding. A preferred construction is obtained by forming the connection films of a gold-palladium prior to the molecular bonding.

The molecular bonded nickel conductor in the present invention provides a significantly higher coefficient of resistance than any presently employed thin or thick film conductor. The conductor thus provides a unique material particularly useful as a temperature sensitive device for continuously monitoring of temperature conditions. After the firing to establish the desired characteristic, the units can be refired without any significant change in the temperature coefficient of resistance.

The present invention provides a highly unique apparatus and method for producing a temperature monitoring unit. The sensing unit provides a high degree of accuracy, stability over long periods of time, a rugged stress-free construction which can be constructed with commercially practical on-line equipment using readily available commercial components.

I claim:

1. The method of forming a temperature sensitive thick film resistance sensor comprising forming a masking means defining a grid pattern, aligning said masking means on a base member formed of a high temperature, electrical insulating material, forcing an air fireable molecular bonding metallic paste including finely divided metal particles of a pure metal having a high temperature coefficient of resistance through said masking means onto said surface to form a deposited conductive thick film as a grid, and firing at an elevated bonding temperature the subassembly to form the paste to a selected resistivity and temperature coefficient and to sinter the grid and thereby molecularly bonding the thick film to the base member.

2. The method of claim 1 wherein said paste is a frittless bonding nickel.

3. The method of claim 1 including the steps of depositing a highly conductive metal film on spaced portions of the thick film, and joining connector leads to the conductive films.

4. The method of claim 3 wherein said highly conductive metal film is selected from the group consisting of silver, silver-platinum, silver-palladium and gold-palladium.

5. The method of claim 1 wherein said masking means is formed by providing a printing screen unit including an emulsion film of a preselected thickness attached to a screen of preselected thickness and mesh opening and exposed to a positive image pattern of resistance grid and removing of the unexposed portions of the emulsion.

6. In the method of claim 5 including the steps of removing the screen unit and allowing the thick film to level, and heating the subassembly to remove volatile materials from the thick film.

7. In the method of claim 6 including screen printing the conductive metal film onto the thick film after said heating, removing the metal film printing screen and allowing the metal film to level, and again heating the subassembly.

8. The method of claim 7 wherein said highly conductive metal film is selected from the group consisting of silver, silver-platinum, silver-palladium and gold-palladium.

9. The method of claim 1 wherein said paste is fritted finely divided vitreous particles and nickel particles uniformly dispersed within an organic binder and solvent.

10. The method of claim 9 wherein said nickel particles have an average size of less than 20 microns.

11. The method of claim 3 including the step of attaching connector leads to the nickel grid.

12. The method of claim 6 including trimming the fired nickel grid to a reference resistance at a preselected temperature, and encapsulating the trimmed subassembly in a protective coating.

13. The method of claim 3 including trimming the fired nickel grid to a reference resistance at a preselected temperature, and encapsulating the trimmed subassembly in a protective coating.

14. The method of claim 13 wherein said coating includes forming a bath of polyurethane and a solvent in a viscous state, dipping the trimmed subassembly in the viscous polyurethane, drying said dipped assembly including a final elevated temperature to form said coating.

15. The method of forming a temperature sensitive thick film resistance sensor comprising forming a printing screen unit including an emulsion film of a preselected thickness attached to a screen of preselected thickness and mesh opening and exposed to a positive image pattern of a resistance grid and removing of the unexposed portions of the emulsion, cleaning a high temperature base member formed of a high temperature electric insulating material to remove contaminant thereon, aligning said screen on said base member, forming an air firable nickel paste including finely divided nickel particles thoroughly mixed with vitreous particles and organic binders and solvents forcing said paste through said screen onto said base member to form a nickel grid of a deposited nickel thick film, allowing the deposited nickel thick film to set to promote leveling of the film, heating the subassembly to outgas the deposited nickel thick film, firing the subassembly in a bell-shaped, heat-temperature pattern including a first relatively low temperature period to remove said organic binders and solvents followed by a high temperature period to form the nickel to a selective resistivity and temperature coefficient and to sinter the nickel particles and thereby anchoring the nickel thick film to the base member.

16. The method of claim 15 including the step of screen printing a highly conductive metal film on spaced portions of said nickel thick film and allowing the subassembly to set.

17. The method of claim 16 wherein said highly conductive metal film is selected from the group consisting of silver, silver-platinum, silver-palladium and gold-palladium.

18. The method of claim 15 wherein connector leads are joined to the nickel grid.

19. The method of claim 18 including the step of joining connector leads to the conductive films, trimming the fired nickel grid to a reference resistance at a preselected temperature, and encapsulating the trimmed subassembly in a thin protective conformal coating.

20. The method of claim 19 wherein said coating includes forming a viscous polyurethane bath of polyurethane and a solvent, dipping the trimmed subassembly in the viscous polyurethane bath, drying said dipped assembly including a final elevated temperature to remove the solvents.

21. The method of claim 19 wherein said coating is a low temperature glass glaze.

* * * * *